US005669495A

United States Patent [19]

West

[11] Patent Number: 5,669,495

[45] Date of Patent: Sep. 23, 1997

[54] DUAL UTILITY CARRYING CASE

[76] Inventor: David T. West, 1925 Maplewood Dr., Hagerstown, Md. 21740

[21] Appl. No.: 639,925

[22] Filed: Apr. 26, 1996

[51] Int. Cl.[6] ..... B65D 85/00

[52] U.S. Cl. ..... 206/317; 206/314; 190/110

[58] Field of Search ..... 206/315.11, 314, 206/317, 523; 190/100, 104, 107, 108, 110, 113

[56] References Cited

U.S. PATENT DOCUMENTS

| | | | |
|---|---|---|---|
| 3,181,693 | 5/1965 | Freistat | 206/523 |
| 3,861,504 | 1/1975 | McGraw | 190/110 |
| 4,106,597 | 8/1978 | Shook et al. | 190/110 |
| 4,173,286 | 11/1979 | Stanko | 206/523 |
| 4,446,900 | 5/1984 | Markovich | 206/317 |
| 4,867,307 | 9/1989 | Bovee | 206/523 |
| 4,966,279 | 10/1990 | Pearcy | 206/315.11 |

FOREIGN PATENT DOCUMENTS

| | | | |
|---|---|---|---|
| 719892 | 11/1966 | Italy | 206/317 |

*Primary Examiner*—David T. Fidei
*Attorney, Agent, or Firm*—Dowell & Dowell

[57] ABSTRACT

A dual utility carrying case for the storage and transportation of objects including firearms which includes a rigid outer case and a lightweight, independently usable inner case which fits snugly in the outer case. The outer case opens at one end to permit removal of the inner lightweight case.

18 Claims, 1 Drawing Sheet

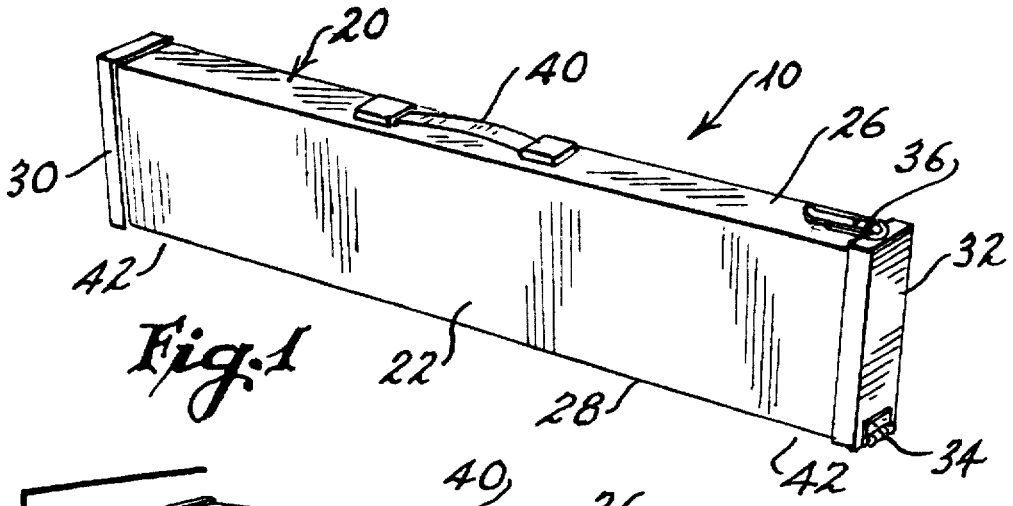
Fig.1
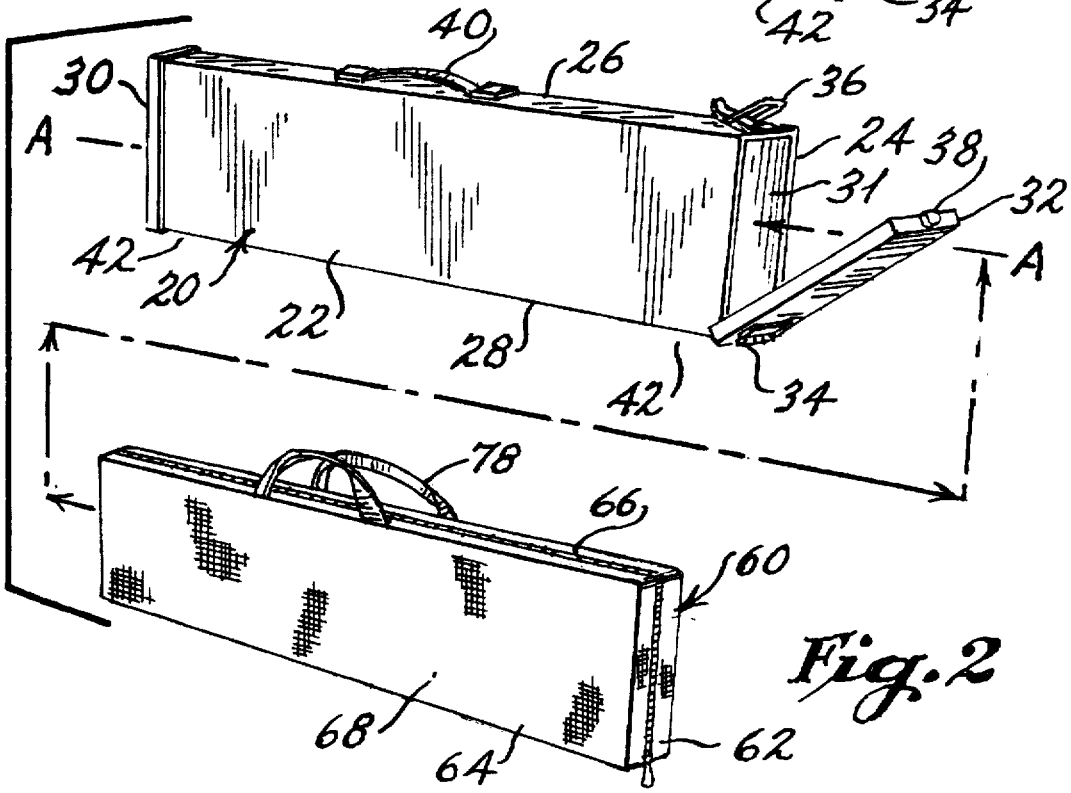
Fig.2
Fig.3
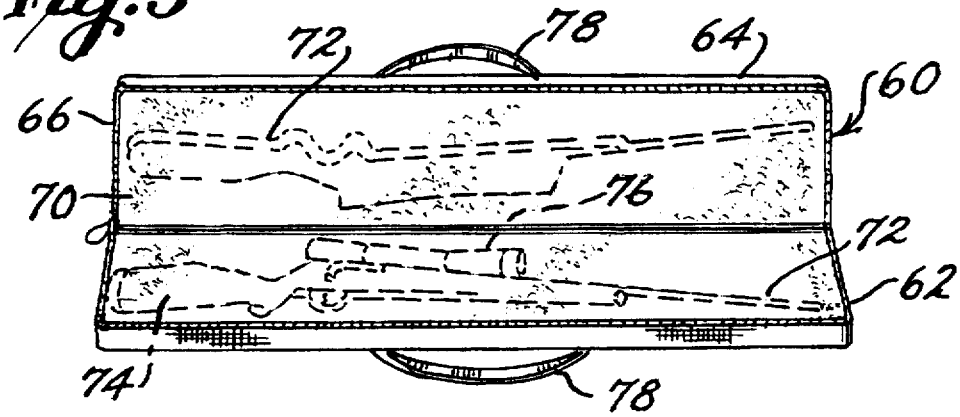

DUAL UTILITY CARRYING CASE

BACKGROUND OF THE INVENTION

1. Field of the Invention

The invention relates generally to the field of portable protective shipping and carrying cases and, more particularly, to such cases having a tough and rigid outer housing and a removable and separately usable lightweight inner cushioned case in which an item is safely retained. The cases have particular utility for the secure shipping or transport of firearms, such as rifles, shotguns and handguns, but may also be used to secure and protect other items such as musical instruments, various scientific testing and related instrumentation and other sensitive and valuable items.

2. History of the Related Art

Portable cases of the type which are utilized to carry, transport or ship firearms and other items are either generally constructed having a rigid housing or a flexible casing. Most rigid cases include a metallic housing having a lid which is connected thereto by an elongated piano-type hinge. The interior of such cases may be lined with a padding material to provide cushioning for seating the firearm or other item within the case. Unfortunately, such rigid cases have limited utility in that the weight of a metallic case and its rigid configuration interfere with ease of personal portability in the field, such as when a hunter must backpack through rough terrain. Also, it is known that the hinge structures associated with conventional metallic gun cases and the like, are subject to damage when improperly handled during the loading, storage or unloading of the cases on either private or commercial carriers.

Flexible gun cases and the like, such as those formed of a fabric, canvas, leather or leather-like material are lightweight and therefore are conducive for use by an individual in the field. However, such flexible and lightweight cases are not adequate to provide security and protection for an item, such as a firearm or an instrument or other sensitive item, which may be roughly handled during either private or commercial shipping of the case.

In view of the foregoing, there has been a need for improved cases for shipping and carrying firearms and other items which provide both the security and impact protection of a rigid case but which further have the portability characteristics of flexible lightweight cases.

SUMMARY OF THE INVENTION

The present invention has been made in view of the above-described deficiencies of the known carrying cases and has as an object to provide a firearm, instrument and equipment case which is strong, durable and lightweight, and is capable of withstanding the severe conditions encountered when being handled, conveyed and transported by commercial or other carrier.

The carrying case of the present invention which has particular utility in the securing and transporting of firearms including rifles, shotguns and handguns, but which may be utilized with other articles or items, includes an outer elongated housing having opposite ends. The outer housing is rigid and is defined by a plurality of side walls which are closed upon one another and define an interior storage chamber. In the preferred embodiment, one of the ends of the housing is sealed or integrally formed with the side walls and an opposite open end is selectively closable by a lid which is pivotally secured to one of the elongated side walls of the housing. A latching mechanism is provided for securing the lid in closed relationship with respect to the housing. A locking mechanism may also be provided for preventing unauthorized access to the storage chamber.

The carrying case also includes an inner lightweight case which is slidably disposed within the storage chamber of the outer rigid housing. The inner casing is sized to fit snugly within the outer rigid housing. The lightweight inner case includes an outer cover having upper and lower portions which are integrally formed with respect to one another and which are selectively joined along their outer edges by a closure fastener which, in the preferred embodiment, is a waterproof zipper. Fitted within the upper and lower cover portions are a pair of oppositely oriented article-conforming support elements. In a preferred embodiment, the article-conforming supports are formed of a closed cell foam material which is lightweight and substantially rigid so that an article contained within formed pockets in each of the supports is adequately protected when stored within the inner case. The article-conforming supports also exhibit a high degree of buoyancy which is sufficient to cause the entire carrying case to float in the event it is accidentally dropped into water even when an article is stored within the inner case.

It is a primary object of the present invention to provide a utility carrying case for firearms and other objects which includes an outer rigid housing which can be secured and locked and which protects the firearms or objects during transit and wherein a lightweight inner case is provided which also protects the firearms or objects but which can be easily manually carried in the field after the inner case is removed from the outer housing.

It is also an object of the present invention to provide a dual utility carrying case for firearms and other objects which includes an outer rigid housing and a lightweight inner case which includes a close cell foam material of sufficient buoyancy to ensure that objects stored within the inner case, as well as the inner case and outer housing, are buoyant in the event the carrying case is accidentally dropped in water.

Additional objects and advantages of the present invention will become apparent from the detailed description which follows and the accompanying drawings.

BRIEF DESCRIPTION OF THE DRAWINGS

In the accompanying drawings:

FIG. 1 is a perspective view of the dual utility carrying case of the preferred embodiment of the present invention;

FIG. 2 is an exploded view of the dual utility carrying case of FIG. 1 showing the outer housing opened and the independently usable inner case removed therefrom; and FIG. 3 is a front elevational view of the inner case shown in FIG. 2 with the inner case being open and showing the opposing article-conforming supports which have been preformed to include pockets for receiving a rifle, as illustrated in dotted line in the drawing figure.

DESCRIPTION OF THE PREFERRED EMBODIMENT

The invention will now be described in detail with reference to the drawing figures in which common reference numbers identify common elements.

With particular reference to FIGS. 1 and 2, the dual utility carrying case 10 of the present invention comprises a rigid outer housing 20 and a lightweight inner case 60. The outer housing is shown as being elongated having a rectangular cross-sectional configuration taken perpendicular to an elongated axis "A—A" of the housing. It should be noted that other cross-sectional configurations may be utilized and be within the teachings of the present invention. The outer housing includes a body portion having opposed side walls 22 and 24, a top wall 26, a bottom wall 28, a closed end 30 and a lid 32 for selectively closing an open end 31. The lid 32 is connected to the bottom wall 28 of the outer housing by a hinge 34. To retain the lid 32 closed over the open end 31 of the housing, latching elements 36 and 38 are provided on the top wall 26 and lid 37, respectively. Further, in order to securely lock the inner container 60 within the outer housing, latching member 36 includes a hasp portion 35 having a slot therein in which a U-shaped locking bar 39 which is securely mounted to the upper wall 26 of the housing extends when the hasp is in a closed position relative to the upper wall. Thereafter, a padlock may be inserted through the locking bar to retain the hasp in a locked or closed position. In this manner, the dual utility carrying case may be secured before the case is placed into either commercial or private shipment so that unauthorized access within the housing is prevented. In the embodiment shown, the lid 32 is the only means for access to the interior storage chamber of the housing 20. In some embodiments, the opposite end may also include a lid which may be selectively opened. Further, it is preferred that a gasket or similar material be provided along the interior portion of the lid 32 to further seal the inner case when it is secured within the outer housing.

The outer case 20 is preferably formed with a welded aluminum construction so as to be corrosion-resistant, lightweight and yet extremely tough and durable. The outer case is designed to prevent any damage to the inner case or contents contained within the inner case even if the outer case is dropped a substantial distance. In some instances, other metals or suitable plastics may be used provided they exhibit the appropriate strength and durability characteristics.

A carrying handle 40 is mounted to the top wall 26 of the outer housing and aluminum angles or housing supports 42 are welded adjacent opposite ends of the bottom wall 28 to provide for wear resistance when the case is placed in contact with a surface.

With particular reference to FIGS. 2 and 3, the inner case 60 of the present invention will be described in greater detail. The inner case will be described as it is constructed for use for retaining a firearm, such as a rifle having a scope mounted thereto. It should be noted that other objects may be stored within the inner case. The inner case includes a base 62 which is hingedly connected by way of an outer protective cover 68 to a lid 64. A closure member such as the zipper 66 is provided for closing the lid relative to the base and the zipper is preferably constructed so as to be waterproof. Other closure fasteners may also be substituted. The base 62 and lid 64 mounted within the protective outer cover function as a pair of opposing article-conforming support members. These article-conforming support members are preferably formed of a high-density, closed cell foam material such as polyethylene or the like which is non-permeable to water. In this manner, no moisture will be trapped by the material and therefore objects, such as firearms which are contained within the inner case, are protected from the adverse effects of moisture. Additionally, the foam material is present in a sufficient amount to provide buoyancy, not only for the inner case and any objects mounted therein, but also for the outer housing. In this manner, if the utility carrying case is accidentally dropped into water, the entire case will float, allowing easy retrieval.

The closed cell foam material also exhibits a degree of rigidity and therefore provides an effective lightweight shell for protecting an article such as a rifle as shown at 74 from damage when it is carried within the inner case and the inner case is removed from the outer housing. This would be particularly true when the inner case is removed so that it can be manually carried in the field during times when the outer case would not be utilized due to the additional weight of the outer housing. Each of the article-conforming support members is routed or otherwise molded or formed to include pockets 72 which are shaped to conform to the object being stored within the case. As shown in FIG. 3, the closed cell foam support material has been routed to include configurations for accepting the rifle 74 having a scope 76 mounted thereto. To further protect the object being stored within the inner case, a soft fabric or felt material 80 is secured, such as by adhesive, to the exposed surfaces of the closed cell foam material.

The outer cover 68 is preferably formed of a durable, lightweight fabric such as nylon which has been treated to provide a measure of water repellency so that the cover further protects the contents of the inner case.

As shown, the inner case is also elongated having a generally rectangular cross-section and is preferably of a size to be slidingly yet frictionally received within the housing 20. Although not specifically shown in the drawings, two or more inner cases may be retained within the same outer housing by simply enlarging the cross-sectional configuration of the outer housing to cooperatively accept the two or more inner cases. The inner case is further provided with a handle 78 to facilitate portability of the inner case when it is carried by an individual in the field.

Further, the article-conforming support member may include multiple recesses, allowing a plurality of objects such as a rifle and a handgun to be carried within the same inner case. When larger outer housing are utilized to transport two or more inner cases, it may also necessary to provide wheels adjacent the closed end wall 30 of the outer housing so that it is not necessary for an individual to totally support the weight of the carrying case.

To further facilitate the utility of the inner carrying cases, the article support portions may be removably mounted, such as through the use of interconnecting hook and loop fastening materials such as Velcro™ within the protective cover so that different article-conforming support members may be selectively placed within the cover as desired by an individual utilizing the carrying case. In other instances, the inner conforming support members may be adhesively secured to the outer protective cover.

In the use of the dual utility carrying case of the present invention, after an article such as a rifle 74 is positioned within the recesses of the inner carrying case and the carrying case sealed utilizing the appropriate fastener, the carrying case is fitted within the outer container or housing after which the lid 32 is closed. After the latch is secured in place, an appropriate locking mechanism may be utilized to prevent further manipulation of the latch. With the articles now contained within the inner protective housing, the articles may be shipped by commercial or independent carriers without fear of damage. Once the carrying case reaches its destination, the inner case may be removed from the outer case. As the inner case is extremely lightweight and easily portable, the inner case can be utilized by an individual in the field where the handling of an outer protective case would not be practical.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. A dual utility carrying case for protectively supporting an object being transported, comprising:

an elongated outer rigid housing defining an interior chamber and outer ends oriented along an elongated axis of the outer housing, at least one of said outer ends being open;

a lid for selectively closing said at least one opened end of said housing;

said housing have a first cross-sectional configuration taken perpendicular to said elongated axis;

an inner lightweight case of a size and having a cross-section similar to said first cross-sectional configuration to be selectively cooperatively and slidingly received within said chamber of said outer housing by being inserted through said open end;

an outer protective cover which encloses said inner case and said inner case including at least one article-conforming support member having a recess formed therein of a configuration so as to cooperatively receive the object therein;

means for closing said protective cover so as to retain an object within said recess of said at least one article-conforming support member; and a means for latching said lid to said outer housing when said inner case is contained within said chamber.

2. The dual utility carrying case of claim 1, in which said at least one article-conforming support member is formed of a substantially water impermeable, closed-cell high density foam material.

3. The dual utility carrying case of claim 2, in which said at least one article-conforming support member is of sufficient buoyancy so as to float the outer housing and the inner case when an object is contained within said inner case and said inner case is stored within said outer housing.

4. The dual utility carrying case of claim 2, wherein said inner case includes a pair of article-conforming support members, each having at least one recess formed therein of a configuration to cooperatively receive an object, said article-conforming support members being mounted within said outer protective cover so that said recesses therein are alignable with one another when one of said article-conforming support members is brought into overlying relationship with respect to the other.

5. The dual utility carrying case of claim 4, wherein said protective cover of said inner case is formed of a water resistant material.

6. The dual utility carrying case of claim 2, in which said outer housing includes a carrying handle and said inner case includes a carrying handle.

7. The dual utility carrying case of claim 2, including a lock means mounted on said outer housing for selectively locking said lid in closed relationship with respect to said housing.

8. The dual utility carrying case of claim 4, in which said at least one article-conforming support member is of sufficient buoyancy so as to float the outer housing and the inner case when an object is contained within said inner case and said inner case is stored within said outer housing.

9. A dual utility carrying case for protectively supporting at least one firearm, comprising:

an elongated outer rigid housing defining an interior chamber and outer ends oriented along an elongated axis of the outer housing, at least one of said outer ends being open;

a lid for selectively closing said at least one opened end of said housing;

said housing have a first cross-sectional configuration;

an inner lightweight case of a size and having a cross-section similar to said first cross-sectional configuration so as to be selectively cooperatively and slidingly received within said chamber of said outer housing by being inserted through said open end;

an outer protective cover which encloses said inner case and said inner case including at least one support member having a recess formed therein to cooperatively receive the at least one firearm therein;

means for closing said protective cover so as to retain the at least one firearm within said recess of said support member; and a means for latching said lid to said outer housing when said inner case is contained within said chamber.

10. The dual utility carrying case of claim 1, in which said at least one support member is formed of a substantially water impermeable, closed-cell high density foam material.

11. The dual utility carrying case of claim 10, wherein said inner case includes a pair of support members, each having at least one recess formed therein of a configuration to cooperatively receive the at least one firearm partially therein, said support members being mounted within said outer protective cover so that said recesses therein are alignable with one another when one of said support members is brought into overlying relationship with respect to the other.

12. The dual utility carrying case of claim 11, wherein said protective cover of said inner case is formed of a water resistant material.

13. The dual utility carrying case of claim 11, in which said outer housing includes a carrying handle and said inner case includes a carrying handle.

14. The dual utility carrying case of claim 11, in which said support member is of sufficient buoyancy so as to float the outer housing and the inner case when the at least one firearm is contained within said inner case and said inner case is stored within said outer housing.

15. The dual utility carrying case of claim 10, in which said support member is of sufficient buoyancy so as to float the outer housing and the inner case when the at least one firearm is contained within said inner case and said inner case is stored within said outer housing.

16. A dual utility carrying case for protectively supporting an object being transported, comprising:

an elongated outer rigid housing defining an interior chamber and outer ends, at least one of said outer ends being open;

a lid for selectively closing said at least one opened end of said housing;

said housing have a first cross-sectional configuration;

an inner lightweight case of a size to be cooperatively received within said chamber of said outer housing;

an outer protective cover which encloses said inner case and said inner case including at least one article-conforming support member having a recess formed therein of a configuration so as to cooperatively receive the object therein;

means for closing said protective cover so as to retain an object within said recess of said at least one article-conforming support member;

said inner case being formed of a water resistant material and said at least one article-conforming support member being of sufficient buoyancy so as to float the outer housing and the inner case when an object is contained within said inner case and said inner case is stored within said outer housing; and a means for latching said lid to said outer housing when said inner case is contained within said chamber.

17. The dual utility carrying case of claim 16 in which said outer housing includes a carrying handle and said inner case includes a carrying handle.

18. The dual utility carrying case of claim 17, wherein said inner case includes a pair of article-conforming support members, each having at least one recess formed therein of a configuration to cooperatively receive an object, said article-conforming support members being mounted within said outer protective cover so that said recesses therein are alignable with one another when one of said article-conforming support members is brought into overlying relationship with respect to the other.

* * * * *